United States Patent [19]

Kulka et al.

[11] 4,128,101

[45] Dec. 5, 1978

[54] TOBACCO COMPOSITIONS CONTAINING 3-ETHOXY-4-HYDROXYBENZALDEHYDE 2,2-DIMETHYL PROPANEDIOL ACETAL

[75] Inventors: Kurt Kulka, New York, N.Y.; Frank Mild, Westwood, N.J.; Frank Fischetti, Jr., Flushing, N.Y.

[73] Assignee: Fritzsche Dodge & Olcott Inc., New York, N.Y.

[21] Appl. No.: 797,508

[22] Filed: May 10, 1977

[51] Int. Cl.[2] ..... A24B 3/12

[52] U.S. Cl. ..... 131/17 R; 426/538; 260/340.7

[58] Field of Search ..... 131/17, 144; 426/538; 260/340.7

[56] References Cited

U.S. PATENT DOCUMENTS 3,991,214 11/1976 Slangan et al. ..... 131/17 R

*Primary Examiner*—Robert W. Michell
*Assistant Examiner*—V. Millin
*Attorney, Agent, or Firm*—Frank M. Nolan

[57] ABSTRACT

3-Ethoxy-4-hydroxybenzaldehyde 2,2-dimethylpropanediol acetal has a unique flavor and aroma which markedly enhance the flavor and aroma of tobacco products and comestibles. Unlike ethyl vanillin from which it is derived, the acetal has a less pronounced vanilla or ethyl vanillin odor and taste and a more intense chocolate by-note.

8 Claims, No Drawings

TOBACCO COMPOSITIONS CONTAINING 3-ETHOXY-4-HYDROXYBENZALDEHYDE 2,2-DIMETHYL PROPANEDIOL ACETAL

This invention relates to 3-ethoxy-4-hydroxybenzaldehyde 2,2-dimethyl-propanediol-acetal and its enhancement of the flavors of tobacco products and comestibles.

The novel 2,2-dimethyl-propanediol acetal of this invention has a different odor and flavor from that of 3-ethoxy-4-hydroxybenzaldehyde (ethyl vanillin). While the 3-ethoxy-4-hydroxybenzaldehyde has a typical pronounced vanilla odor and taste, in contrast, the acetal of this invention has this property to a considerably lesser extent, but it has an additional smooth, not harsh odor and taste with a chocolate by-note. These characteristics render it useful in improving the flavor and aroma properties of tobacco and comestibles.

In addition, while ethyl vanillin is practically insoluble in oils and fats, the acetal of this invention is oil-soluble to 25% or more in edible vegetable oils and fats. Consequently, the acetal may be used to great advantage in comestibles. Moreover, since the solution of the acetal in edible vegetable oils or fats is relatively non-volatile, the comestibles in which it is incorporated may be subjected to elevated temperatures in the production, for example, of baked goods.

The 2,2-dimethyl-propanediol-acetal of 3-ethoxy-4-hydroxybenzaldehyde has the following formula:

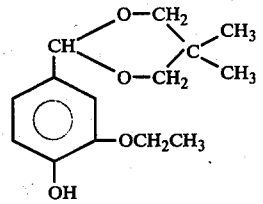

The 2,2-dimethyl-propanediol acetal is produced by combining 3-ethoxy-4-hydroxybenzaldehyde (ethyl vanillin) with a small molecular excess of 2,2-dimethyl-propanediol in the presence of a suitable solvent such as benzene. The resulting mixture is heated to facilitate solution. To the resulting solution is added a small amount of oxalic acid as a catalyst. The reaction mixture is refluxed, with a water trap, until the theoretical amount of water of reaction is collected in the water-trap. The resulting acetal may be washed successively with an aqueous sodium carbonate solution and warm water. The resulting reaction mixture may be liberated from the solvent by distillation at an ejector vacuum through a ½-foot Vigreux column at steam bath temperature. The product may be purified by fractional distillation.

The reaction which takes place is as follows:

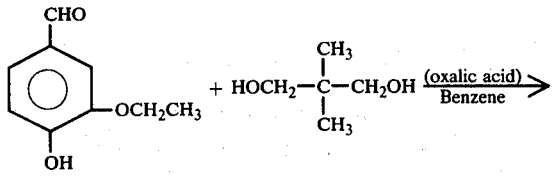

Ethyl Vanillin 2,2-Dimethylpropanediol

-continued

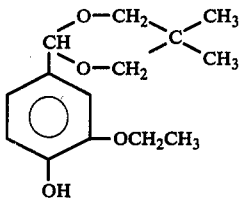

The 2,2-dimethyl-propanediol acetal of 3-ethoxy-4-hydroxybenzaldehyde of this invention may be incorporated in tobacco products and comestibles. The term "tobacco" as used in the description and claims in this application, includes natural tobacco, tobacco substitutes, or a combination of both. The term "comestibles" includes foods, food flavors, beverages and sugar syrups.

The amount of the novel acetal in tobacco or comestibles may be 1 to 10,000 ppm by weight, desirably 10 to 1,000 ppm by weight, and preferably 20 to 500 ppm by weight.

For specific tobacco products, the levels by weight of the novel acetal are desirably:

Cigarettes — 1 to 500 ppm by weight
Cigars — 20 to 5,000 ppm by weight
Chewing Tobacco — 50 to 5,000 ppm by weight
Snuff — 50 to 5,000 ppm by weight
Pipe Tobacco — 50 to 10,000 ppm by weight The acetal of this invention may be used as an aroma and taste-modifying agent in the manufacture of tobacco products which may be comprised of one or more of the following: tobacco leaf, tobacco stems, homogenized tobacco leaf and synthetic smoking materials of non-tobacco origin. It may also be used as an odor and taste-modifying agent in the manufacture of tobacco flavor compositions commonly used to sweeten, enhance, modify or otherwise alter tobacco blends, to improve the aroma of the blend and/or the taste and aroma characteristics of the smoke of the blend when burned. When median or low grade tobaccos are used in the manufacture of tobacco compositions, the off-notes of aroma and taste of such tobacco are significantly altered and improved by the addition of the acetal of this invention.

Addition of the acetal of this invention to tobacco in varying amounts ranging from 1 ppm up to 600 ppm has the following effects:

a. Prior to smoking, a pleasant, sweet, light aroma at the lower levels and a distinctly sweet, rich, chocolate-like aroma at the higher levels.

b. Upon smoking, the mainstream becomes smoother and more mellow at the lower levels, whereas at the higher levels, a sweet rich chocolate-like aroma and taste become evident in the mainstream.

The acetal of this invention is readily soluble in ethyl alcohol or propylene glycol and to a lesser degree in glycerine. This excellent solubility quality is of prime significance when the acetal is incorporated into various flavor compositions. Accordingly, the acetal may be advantageously incorporated in the tobacco or comestible by dissolving the acetal in a volatile solvent such as ethyl alcohol 70% by methods described in the typical examples.

A more comprehensive understanding of this invention is obtained by reference to the following examples:

EXAMPLE I

Preparation of 3-Ethoxy-4-hydroxybenzaldehyde 2,2-Dimethyl-propanediol Acetal The following were combined in a 2 liter reaction flask: 166 g (1 mol) of 3-ethoxy-4-hydroxybenzaldehyde (ethyl vanillin), 135 g (1.3 mol) of 2,2-dimethyl-propanediol, and 300 ml of benzene (solvent), and heated to 50° C to facilitate solution. To the resulting solution was added in one portion 2 g of oxalic acid (catalyst). The reaction mixture was refluxed with a water-trap for 2 hours until the theoretical amount of the water of reaction was collected in the water-trap. Reaction temperature rose from 72° C at the start to 90° C at the finish of the process. The reaction mixture was cooled to room temperature and was washed successively twice with 100 ml of warm (40° C) water, once with 100 ml of aqueous 5% sodium carbonate solution, twice with 100 ml of aqueous 5% sodium bicarbonate solution and finally twice with 50 ml of warm (40° C) water. The resulting reaction mixture was liberated from the solvent (benzene) by distillation through a ½ foot Vigreux column at an ejector vacuum at steam bath temperature. The product was purified by fractional distillation through a ½ foot Vigreux column at 1 mm vacuum.

| Temp. Vapor | Temp. Flask | ml. | wt. | |
|---|---|---|---|---|
| 130 - 154° C | 175 - 172° C | 10 | 12 | Front Section |
| 157° C | 169 - 170° C | 184 | 203 g | MAIN FRACTION (Product) |
| | Residue | | 5 g | |

The yield was 203 g which was 80% of the theoretical (252 g).

The resulting 3-ethoxy-4-hydroxybenzaldehyde 2,2-dimethylpropanediol acetal was a heavy viscous liquid having the following physical properties:

R.I. 20° : 1.5238

IR: Desired product

GLC: One peak

It solidified on standing at room temperature and had a m.p. of 59.5° to 61.5° C.

EXAMPLE II

Cigarette Tobacco Containing 3-Ethoxy-4-Hydroxybenzaldehyde 2,2-Dimethyl-Propanediol Acetal To a standard cigarette blend comprised of flue-cured, cased burley (burley which has been sweetened with sugars, cocoa, licorice, etc.) and oriental leaf was added small amounts of CRS (cut rolled stems) and HTL (homogenized tobacco leaf) so that the percentages by weight of the final blend were as follows:

| | |
|---|---|
| 52% | Flue-cured tobacco |
| 32% | Cased burley tobacco |
| 10% | Oriental tobacco |
| 3% | CRS |
| 3% | HTL |
| 100% | |

This blend shall be referred to as the basic blend. 1,000 g of the above basic blend was placed in a rotating drum and sprayed with 20 ml ethyl alcohol 70%. This blend shall now be referred to as the control blend. From this control blend were made 80 mm filter-tipped cigarettes which shall be referred to as the control cigarettes.

Another 1,000 g of the basic blend were placed in a rotating drum and sprayed with 20 ml ethyl alcohol 70% in which was dissolved 0.5 g 3-ethoxy-4-hydroxybenzaldehyde 2,2-dimethyl propanediol acetal. 80 mm filter-tipped cigarettes were then made from this blend. Both these cigarettes and the control cigarettes were packed in separate air-tight containers for a period of 3 weeks before submitting them to a smoke test panel for comparison.

The panel determined that the control cigarettes had somewhat of a burnt, acrid characteristic in the taste and aroma of the smoke, whereas in the flavored cigarette, this burnt, acrid character was substantially reduced while there was a definite increase in the richness and fullness of the smoke.

EXAMPLE III

Virginia Type Cigarette Tobacco Blend Containing 3-Ethoxy-4-Hydroxybenzaldehyde 2,2-Dimethyl-Propanediol Acetal A so-called straight Virginia type cigarette blend was made comprised of flue-cured tobacco of various grades and of varied origin. Control cigarettes were made from this blend in the same fashion as in Example I after having sprayed 20 ml ethyl alcohol 70% on 1,000 g of the blend.

On another 1,000 g of blend was sprayed 20 ml ethyl alcohol 70% in which was dissolved 0.1 g 3-ethoxy-4-hydroxybenzaldehyde 2,2-dimethyl-propanediol acetal. Cigarettes were made from this flavored tobacco and stored for a period of 3 weeks, as were the control cigarettes, before being submitted to the test panel for evaluation.

Upon smoking the cigarettes, the panel determined that the flavored cigarettes were sweeter and richer in taste and aroma than the control cigarettes without detracting from the natural flue-cured tobacco taste.

EXAMPLE IV

Pipe Smoking Tobacco Containing 3-Ethoxy-4-Hydroxybenzaldehyde 2,2-Dimethyl-Propanediol Acetal To a standard pipe tobacco mixture comprised of 90% burley leaf and 10% flue-cured leaf was applied 3-ethoxy-4-hydroxybenzaldehyde 2,2-dimethyl-propanediol acetal in the following manner:

20 ml of a 5% solution (weight for weight) of the acetal in propylene glycol was sprayed on 1,000 g of pipe tobacco mixture in a rotating drum. The treated mixture was then packed in an air-tight container for a period of 2 weeks before testing.

Upon smoking this treated pipe mixture, the panel found the smoke taste to be sweet and mild with no residual after-taste or tongue-bite. The smoke aroma had a distinctive chocolate-like characteristic.

EXAMPLE V

Honey Flavor Composition Containing 3-Ethoxy-4-Hydroxybenzaldehyde 2,2-Dimethyl-Propanediol Acetal An oil soluble honey flavor composition containing 3-ethoxy-4-hydroxybenzaldehyde 2,2-dimethyl-propanediol acetal is prepared by mixing together the following components:

| Component | Parts by Weight |
|---|---|
| Phenylacetic Acid | 2.4 |
| Methyl Phenylacetate | 2.4 |
| Methyl Acetophenone | 0.1 |
| Oil Celery Seed | 0.1 |
| Oil Geranium | 0.1 |
| Ethyl vanillin dimethyl-propanediol acetal | 2.4 |
| Vegetable oil | 92.5 |
| | 100.00 |

Alternatively, ethyl alcohol may be substituted for the vegetable oil to produce an alcohol soluble honey flavor composition.

The above described alcohol soluble honey flavor composition was applied to a standard cigarette blend comprised of 60% flue-cured leaf, 30% cased burley and 10% oriental leaf in the following manner:

0.6 ml of alcohol soluble honey flavor was dissolved in 20 ml of 70% ethyl alcohol and this solution was then sprayed on 1000 g of the above tobacco blend. The amount of ethyl vanillin dimethyl-propanediol acetal was approximately 15 ppm by weight of the tobacco. Cigarettes made thereof were then packed in an air-tight container for 2 weeks before testing.

Upon smoking these cigarettes, the panel determined the taste to be sweet and smooth with well-rounded characteristics.

The oil-soluble honey flavor composition may be incorporated in the shortening used in baked goods in the proportion of 6 fluid ounces of composition to 100 pounds of shortening. In addition to utilization in the shortening for baked goods, the oil-soluble honey flavor composition may also be employed for glazing baked goods and for fondant fillings.

The ability of the oil-soluble honey flavor composition containing ethyl vanillin 2,2-dimethyl propanediol acetal to withstand baking temperature is illustrated by the following example:

| POP-OVERS | |
|---|---|
| Flour | 25.9 |
| Milk | 51.9 |
| Eggs | 13.8 |
| Shortening (flavored at 6 oz. to 100 lbs. with oil-soluble honey flavor composition) | 3.4 |
| Sugar | 3.4 |
| Salt | 1.6 |
| | 100.0 |

Preheat oven to 475° F.

Cook for 12 minutes at 475° F, then reduce heat to 350° F and bake for 12 minutes longer.

Puncture with toothpick and cook 5 additional minutes.

Remove from pans and taste.

A honey flavor is clearly evident even after the pop-over cools down, attributable to the blending of the oil-soluble honey flavor composition with the shortening. If the honey flavor composition were not oil-soluble, much of the flavor would have been volatilized and lost during the baking.

EXAMPLE VI

Chocolate Flavor Composition Containing 3-Ethoxy-4-Hydroxybenzaldehyde 2,2-Dimethyl-Propanediol Acetal A chocolate flavor composition containing 3-ethoxy-4-hydroxybenzaldehyde 2,2-dimethyl-propanediol acetal is prepared by mixing together the following components:

| Component | Parts by Weight |
|---|---|
| λ-Nonalactone | 0.1 |
| Amyl Phenylacetate | 2.6 |
| Benzyl Butyrate | 0.1 |
| 2,6 Dimethyl Pyrazine | 0.2 |
| 2,3,5,6 Tetramethyl Pyrazine | 0.2 |
| 3,4 Dimethoxy Benzaldehyde | 0.2 |
| 3-Methyl Butyraldehyde | 0.2 |
| Ethyl Vanillin Dimethyl Propanediol Acetal | 3.0 |
| Cocoa Nibs Extract | 60.0 |
| Propylene Glycol | 33.4 |
| | 100.0 |

The above specified chocolate flavor composition was applied to a 1000 g batch of a standard 100% burley pipe mixture by spraying on the tobacco 20 ml of a solution comprised of 5 ml of the chocolate flavor composition, 5 ml propylene glycol and 10 ml water. The amount of ethyl vanillin dimethyl propanediol acetal was approximately 150 ppm by weight of the tobacco. The flavored pipe mixture was then packed in an air-tight container for 2 weeks before being tested.

Upon smoking this treated mixture, the test panel determined the smoke taste to be very rich and sweet with the aroma possessing a very distinct natural chocolate characteristic.

A carbonated chocolate flavor beverage may be produced by mixing ½ fluid ounce of the chocolate flavor composition with 1 gallon of 65% sugar syrup. One fluid ounce of this flavored sugar syrup is added to sufficient carbonated water to produce 6 fluid ounces of carbonated beverage.

EXAMPLE VII

Maple Flavor Composition Containing 3-Ethoxy-4-Hydroxybenaldehyde 2,2-Dimethyl-Propanediol Acetal A maple flavor composition containing 3-ethoxy-4-hydroxybenzaldehyde 2,2-dimethyl propanediol acetal is prepared by mixing together the following components:

| Components | Parts by Weight |
|---|---|
| Cyclotene | 0.2 |
| Tincture Balsam Peru | 0.5 |
| Oil Cognac Green | 0.1 |
| Ethyl Alcohol 95% | 6.4 |
| Coffee Distillate | 14.0 |
| Ethyl Vanillin Dimethyl Propanediol Acetal | 3.0 |
| Tincture Foenugreek | 75.8 |
| | 100.0 |

The above described maple flavor composition was applied to a smoking tobacco blend prepared by combining 50 parts by weight of flue-cured leaf with 50 parts by weight of cased Burley tobacco. 1000 g of this blend was sprayed with 20 ml of maple flavor solution comprised of 5 ml of the above specified maple flavor composition, 5 ml propylene glycol and 10 ml water.

The amount of ethyl vanillin dimethyl propanediol acetal was approximately 150 ppm by weight of the tobacco treated. This treated pipe mixture was then packed in an air-tight container for a period of 2 weeks before testing.

Upon smoking this treated blend, the panel found the smoke taste to have a rich, sweet character with nutty, woody notes reminiscent of natural maple flavor.

A maple flavor syrup to be used for pancakes and in desserts is prepared by mixing ½ fluid ounce of the above specified maple flavor composition with 1 gallon of 65% sugar syrup.

What is claimed is:

1. A composition comprising tobacco having incorporated therein the compound 3-ethozy-4-hydroxy-4-benzaldehyde 2,2-dimethyl-propandiol acetal having the formula:

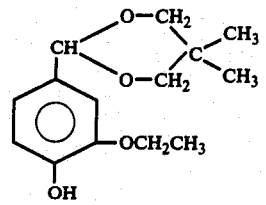

2. A tobacco composition comprising tobacco and 1 to 10,000 ppm by weight of the compound of claim 1.

3. A composition comprising tobacco and 10 to 1,000 ppm by weight of the compound of claim 1.

4. A composition comprising cigarette tobacco and 1 to 500 ppm by weight of the compound of claim 1.

5. A composition comprising cigar tobacco and 20 to 5,000 ppm by weight of the compound of claim 1.

6. A composition comprising chewing tobacco and 50 to 5,000 ppm by weight of the compound of claim 1.

7. A composition comprising snuff and 50 to 5,000 ppm by weight of the compound of claim 1.

8. A composition comprising pipe smoking tobacco and 50 to 10,000 ppm by weight of the compound of claim 1.

* * * * *

UNITED STATES PATENT OFFICE

CERTIFICATE OF CORRECTION

Patent No. 4,128,101 Dated December 5, 1978

Inventor(s) Kurt Kulka et al.

It is certified that error appears in the above-identified patent and that said Letters Patent are hereby corrected as shown below:

Column 7, line 15, delete "-4-", second occurrence.

Column 7, line 15, "ethozy" should read --- ethoxy ---.

Column 7, line 16, "propandiol" should read --- propanediol ---.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*